United States Patent [19]

Rutsch et al.

[11] Patent Number: 4,633,858

[45] Date of Patent: Jan. 6, 1987

[54] MASSAGE DEVICE WITH PINCHING ACTION

[76] Inventors: Hubert Rutsch, 10 bis, route de Saint-Julien, Geneva; Gilbert Golay, 5, Tour de Boël, both of Geneva; Daniele Muhlemann, 81, route de Troinex, 1256 Troinex, all of Switzerland

[21] Appl. No.: 624,993

[22] Filed: Jun. 26, 1984

[30] Foreign Application Priority Data

Jul. 26, 1983 [CH] Switzerland ..... 4081/83

[51] Int. Cl.[4] ..... A61H 7/00; A61H 23/00

[52] U.S. Cl. ..... 128/59; 128/60; 128/55

[58] Field of Search ..... 128/55, 54, 59, 60, 128/61, 44, 45, 48, 51; 123/52 A

[56] References Cited

U.S. PATENT DOCUMENTS

| | | | |
|---|---|---|---|
| 565,475 | 8/1896 | Lindahl | 128/55 |
| 4,041,938 | 8/1977 | Wintoniw | 128/55 |
| 4,195,613 | 4/1980 | Bratt et al. | 123/52 A |

FOREIGN PATENT DOCUMENTS

| | | | |
|---|---|---|---|
| 117204 | 4/1930 | Austria | 128/55 |
| 1126798 | 7/1956 | France | 128/44 |

OTHER PUBLICATIONS

1978 Oldsmobile Service Manual, General Motors Corp., 1977, pp. 6A2-1 and 6A2-2.

*Primary Examiner*—Edgar S. Burr
*Assistant Examiner*—Tonya Eckstine
*Attorney, Agent, or Firm*—Birch, Stewart, Kolasch & Birch

[57] ABSTRACT

A power-driven massager utilizing crankshafts housed in a casing and supported by bearings secured to a pair of parallel side walls of the casing. Connecting rods are mounted to the crankpins of the crankshafts and extends through elliptical guide holes formed in the upper surface of the casing; these guide holes are disposed in staggered relationship; the crankshafts are rotatably driven at one end and the movement of the connecting rods corresponds substantially to the movement of the fingers of a masseur.

3 Claims, 3 Drawing Figures

MASSAGE DEVICE WITH PINCHING ACTION

BACKGROUND OF THE INVENTION

The present invention relates to massage devices and has specific reference to an improved device of this character.

The efficiency of massage as a therapeutic and hygienic method has been known since very ancient times. In China and India massage was current practice about four thousand years ago, and constituted an essential accessory with the Greeks and Romans. Of course, at first massage was performed in a completely empirical form and came into use in medical practice only during the nineteenth century.

Massage is based on physiological laws. Thus, a massage performed on a metameric area may attenuate or even eliminate the pain emanating from the underlying or internal organ. The cutaneous vasomotor disturbations caused by the massage facilitate the subjacent circulation. Massage may also facilitate the resorption of interposition liquids. Finally, massage prepares muscles for a subsequent activity by drawing a larger amount of blood into and heating, the muscles, whereas a massage applied after the strain of physical efforts will relax the musculature and restore its flexibility.

Many diseases and disorders can be treated with an appropriate massage. This applies notably to cellulitis, sequellae of fractures, sprains, luxations, hydarthrosis, arthritis. The main forms of massage manipulation technique are light touch, scalp massage, rubbing, pressure, kneading, pinching, vibration and percussion.

The massage performed by human hands is by far more efficient than the massage accomplished with an apparatus. Besides, a massager driven as a rule by an electric device can be used only for one and sometimes two different manipulations. Most massagers, usually of the vibrator or vibro-massager type, are simply apparatus intended for applying vibration to the human body. Other devices have been proposed in the art which reproduce other types of manipulations but not the pinching effect. Now the manipulations effected by the hands of a masseur are seldom of a single type, they are mostly compound manipulations, an effect hitherto not obtained by any of the many massagers proposed up to now.

SUMMARY OF THE INVENTION

It is the primary object of the present invention to fill this gap by providing a power-driven massager capable of imitating as faithfully as possible the movements of the human fingers during the massage.

The massager according to the instant invention is characterized by the fact that it includes at least one rotatably driven crankshaft having its end journals engaged in bearings supported by two opposite lateral walls of a casing, that the crankpins of the crankshaft support the big ends of connecting rods of which the free and rounded small ends protrude from the upper surface of the casing, the bodies of the connecting rods extending through two rows of guide holes, that the centre lines of the two rows are disposed on either side of the plane perpendicular to said upper surface of the casing, said plane containing the geometrical axis of rotation of the relevant crankshaft, that the guide holes of one row alternate with those of the other row, whereby two adjacent connecting rods engaging two adjacent guide hole, one per row, are inclined on one and the other side, respectively, of said plane perpendicular to the upper surface of the casing and containing the geometrical axis of rotation of the crankshaft.

During the crankshaft rotation, the free ends of the connecting rod which are disposed on either side of the plane perpendicular to the upper surface of the casing and containing the geometrical axis of rotation of the crankshaft perform a compound movement comprising a movement perpendicular to the plane of said upper surface, which corresponds substantially to a kneading manupulation; the eccentric position of the crankshaft crankpins in relation to the axis of rotation and the fact that the connecting rods are guided by said guide holes causes the free ends of the connecting rods to be moved alternatively towards and away from each other, thus producing a pinching action.

According to a preferred form of embodiment of the invention, the massager comprises at least two crankshafts and the arrangement of the free ends of the connecting rods as seen in plane view from above, is such that these free ends are staggered, thus increasing the pinching effect which, on the other hand, is strongly recommended for the treatment of cellulitis.

Since the crankshaft or crankshafts of the massager according to the present invention is or are driven preferably by an electric motor capable of operating at high speed, one may reasonably expect that the reciprocating motion imparted to the connecting rods is capable of producing a vibratory massage.

The invention will now be described more in detail with reference to the attached drawings.

THE DRAWINGS

DESCRIPTION OF THE PREFERRED EMBODIMENT

The massager according to the present invention includes a casing 1 consisting of two portions 2 and 3 in mutual sliding engagement. The first portion 2 has a U-shaped cross-section with its upper ends **2*a* and 2*b* bent inwardly to constitute coplanar and relatively narrow ledges. The second portion 3 is also U-shaped, and adapted to slide in the first portion 2. This specific structure of casing 1** is given by way of example only and in actual practice a completely different configuration may be contemplated, if desired.

Figure 1:
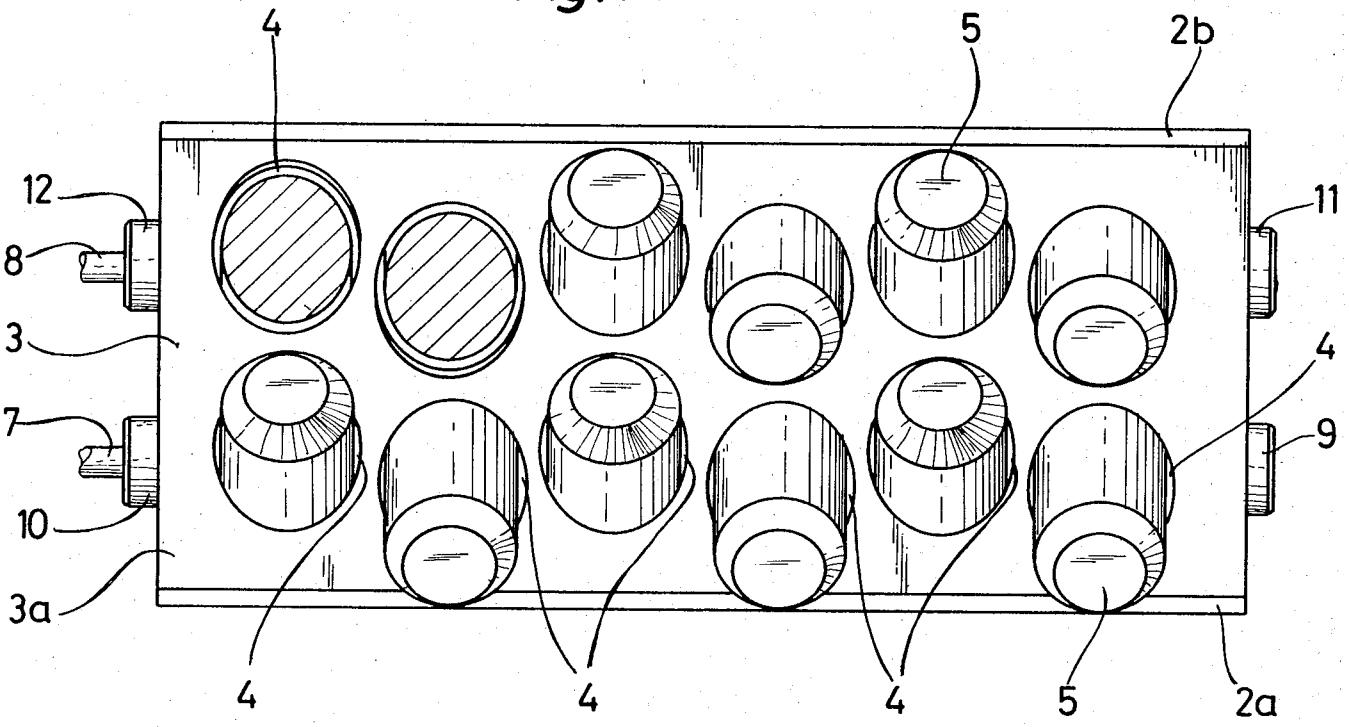
FIG. 1 is a plane view from above of a two-crankshaft massager.
Figure 2:
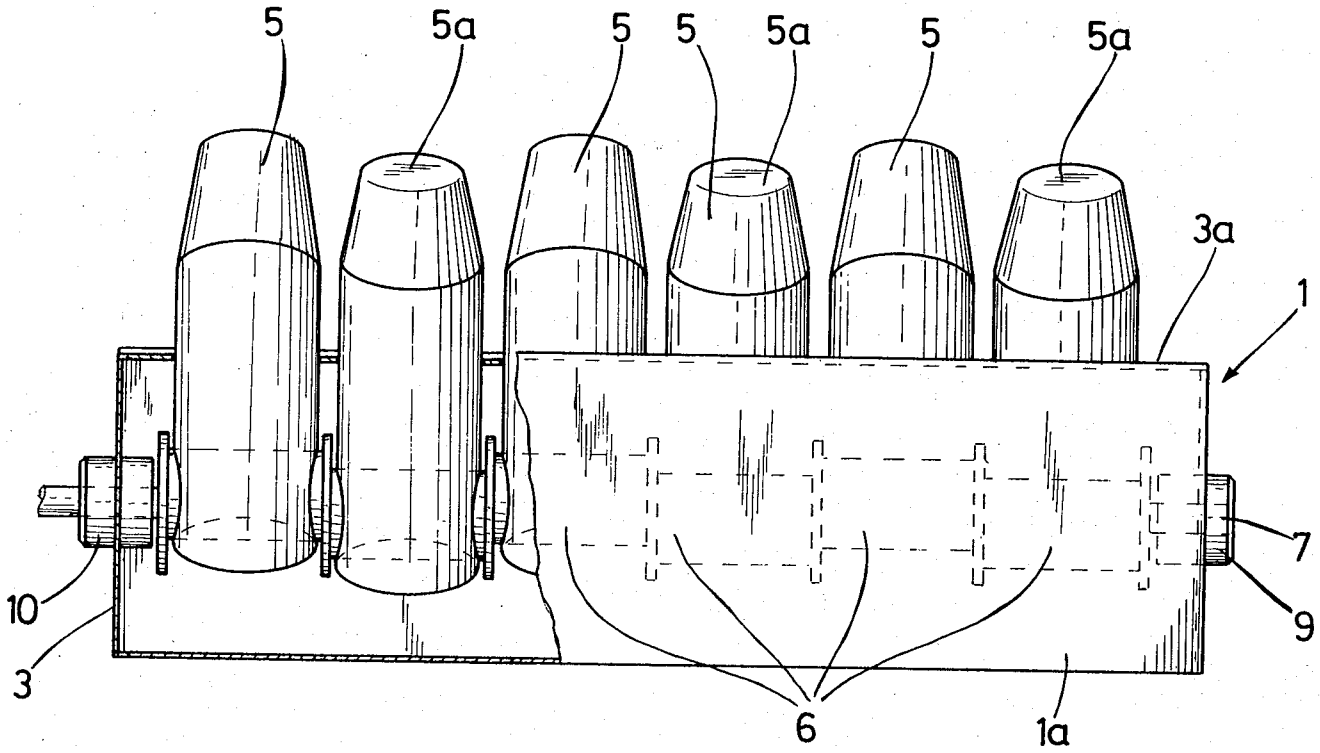
FIG. 2 is an elevational view with parts broken away of the device shown in FIG. 1.
Figure 3:
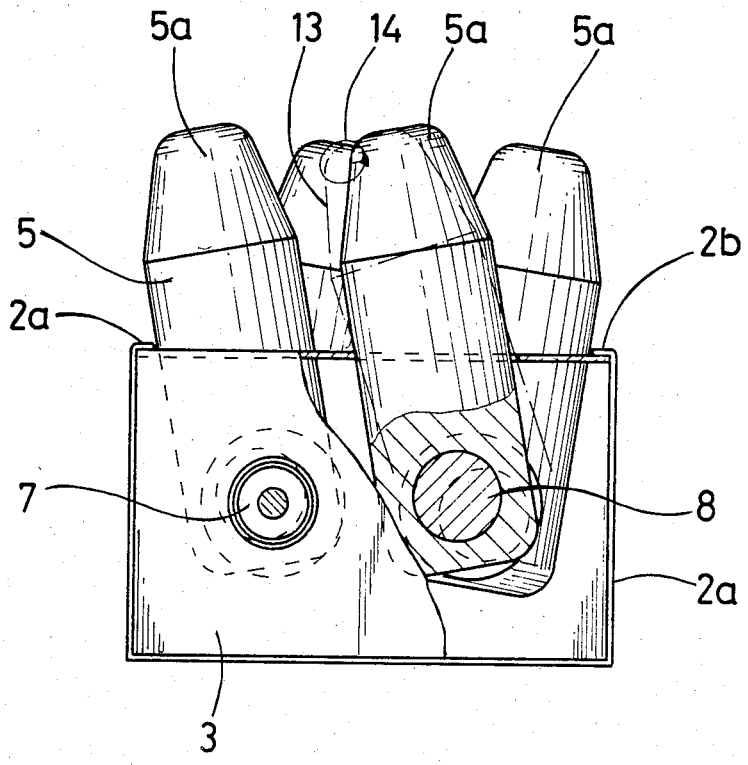
FIG. 3 is an end view of the device of FIG. 1.

The upper surface **3*a* of portion 3 utilizes parallel rows of guide holes 4 disposed in staggered relationship. The bodies of connecting rods 5 pass through the holes 4 and the driven ends of connecting rods 5 engage the crankpins 6 of a pair of parallel crankshafts 7 and 8. The center lines of two alternate rows of holes 4 lie on either side of the plane containing the geometrical axis of the corresponding crankshaft 7 or 8, this plane being perpendicular to the upper surface 3*a* of the casing. Both crankshafts 7 and 8 have their end journals engaged in bearings 9,10, and 11,12, respectively supported by the side arms of the second U-shaped portion 3 constituting the casing 1. The means for driving the crankshafts 7 and 8 are either housed in the casing 1 or disposed externally thereof, and in this last case both crankshafts project on one side the casing as shown in FIGS. 1 and 2. The connecting rods 5 are substantially cylindrical and their free ends have a slightly tapered lateral surface with a rounded surface 5***a*. The guide holes 4 have an elliptical configuration. The major axis of the ellipse is orthogonal to the geometrical axis of rotation of crankshafts 7,8 to allow a slight movement of the connecting rods in the direction of this major axis of the ellipse, as necessary to prevent the wedging of the connecting rods due to their slanted position with respect to the plane of face 3*a* and to the circular movement imparted to the free ends of connecting rods 5 about the geometrical axis of the corresponding crankshaft. The position of the connecting rods in the three figures of the drawings is not an end position but an intermediate position. However, one connecting rod is shown in its endmost position and in chain-dotted lines at 13 in FIG. 3. The loop 14 with an arrowhead shows the complete compound movement accomplished by one point of the end 5*a* of a connecting rod 5. It will be seen that this compound movement actually consists of a vertical movement (corresponding to the kneading movement) and of a horizontal movement which, in combination with a similar movement of an adjacent connecting rod, corresponding to a pinching action.

It is clear that the number of connecting rods and also of crankshafts may be increased as a function of the projected use of the device. All the crankshafts may be driven for example through a worm meshing with corresponding gears secured to crankshafts 7,8. Furthermore, these crankshafts may be rotatably drive in synchronism or not.

The present invention having been thus described, it should be apparent that modifications could be made to the various components of the system, as would occur to one of ordinary skill in the art without departing from the spirit and scope of the present invention.

What is claimed is:

1. Massager for massaging a selected portion of the human body comprising:

at least one rotatably driven crankshaft having its end journals engaged in bearings supported by two opposite lateral walls of a casing;

crankshaft crakpins supporting a plurality of connecting rods having their small ends free, rounded and projecting from a top surface of said casing, the bodies of said connecting rods passing through corresponding elliptical shaped holes along the top surface of said casing wherein said elliptical holes are disposed in a staggered relationship in two parallel rows along the upper surface of said casing thereby permitting the movement of the connecting rods transversely of the longitudinal dimension of said rods to create a pinching action with respect to the portion being massaged;

the center lines of said rows being disposed on either side of a plane perpendicular to said top surface of the casing, said plane defining a geometrical axis of rotation of the corresponding crankshaft, the guide holes of one row alternating with the guide holes of the other row, whereby two adjacent connecting rods engaging two adjacent holes, one per row, are inclined on one and the other side, respectively, of said plane perpendicular to said upper surface of the casing and containing the geometrical axis of rotation of said crankshaft.

2. The massager of claim 1, which comprises two crankshafts, said top surface of said casing comprising four rows of holes disposed in staggered relationship.

3. The massager of claim 1, wherein the bodies of said connecting rods are cylindrical and the guide holes formed through said top surface of said casing have an elliptical configuration, with the major axis of the ellipse disposed at right angles to the geometrical axis of rotation of the crankshaft.

* * * * *